United States Patent [19]

Rarey

[11] 4,218,493

[45] Aug. 19, 1980

[54] ELECTROSTATIC REPAIR COATING

[75] Inventor: Kenneth W. Rarey, Santa Ana, Calif.

[73] Assignee: The Continental Group, Inc., New York, N.Y.

[21] Appl. No.: 856,996

[22] Filed: Dec. 2, 1977

[51] Int. Cl.[2] ..... B05D 1/06; B05D 1/36; B05D 3/02

[52] U.S. Cl. ..... 427/27; 427/14.1; 427/33

[58] Field of Search ..... 427/14, 27, 140, 142, 427/25, 26, 28, 29, 13, 33, 39, 40, 41; 96/1.5; 204/181 R, 181 C, 181 T; 264/36

[56] References Cited

U.S. PATENT DOCUMENTS

| | | | |
|---|---|---|---|
| 2,990,293 | 6/1961 | Towlmin | 427/29 |
| 3,616,394 | 10/1971 | Koepke et al. | 204/181 |
| 3,816,289 | 6/1974 | Landauer et al. | 204/181 C |
| 3,833,365 | 9/1974 | Hiwano et al. | 96/1 SD |
| 3,895,127 | 7/1975 | Comizzoli | 427/39 |
| 3,911,170 | 10/1975 | Honjo et al. | 427/140 |
| 3,926,628 | 12/1975 | Honjo | 427/14 |

*Primary Examiner*—James R. Hoffman
*Attorney, Agent, or Firm*—Charles E. Brown

[57] ABSTRACT

A method of uniformly coating and repairing the surface of a conductive substrate comprising the steps of coating the conductive substrate with a basecoat, charging the basecoat with a charge of a given polarity, charging a repair material with a charge of the same polarity as the charged basecoat, applying the charged repair material to the charged basecoat whereby the flaws of the charged basecoat are repaired, and curing the repaired basecoat.

11 Claims, 6 Drawing Figures

ELECTROSTATIC REPAIR COATING

This invention relates to a method of repairing flaws in electrically insulated coatings on conductive substrates. Such coatings may beneficially be protective coatings on container units.

In many coating applications of conductive substrates, two almost continuous coatings are applied to the substrates to insure relatively complete coverage thereof. Each coating exhibits flaws, such as pinholes, but the likelihood that the flaws of one coat will be generally aligned with the flaws of another coat is relatively small, and hence adequate coverage results are produced. There are several disadvantages associated with the coating application of the conductive substrate, such as an end unit of a container unit. In attempting to minimize the quantity of material, two thin coats are applied to the end unit, and the application thereof often produces pinholes in the coating. In other situations, a coating thick enough to be free of pinholes normally exhibits other deficiencies such as runs, drapes or porosity.

The object of this invention is to selectively apply a coating to flaws such as pinholes, inclusions of foreign matter, thin spots in a thin coating on a conductive substrate or end unit to provide acceptable coverage with a minimum quantity of coating material utilized. A uniform coating, as provided in accordance with the novelty of the present invention, will minimize flaking or peeling associated with several applications of coating material.

With the above, and other objects in view that will hereinafter appear, the nature of the invention will be more clearly understood with reference to the detailed description, the appended claims and the several views illustrated in the drawings.

Figure 1:
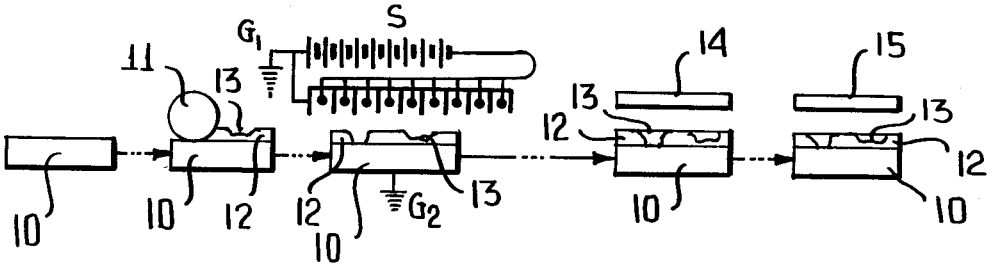
FIG. 1 is a diagrammatic showing of the various steps involved in the method of this invention.

Referring now to the drawings in detail, it will be seen that there is shown in the diagrammatic sketch the steps of the method of this invention.

A conductive base or substrate 10 is conveyed along a path (not specifically illustrated) to a coating station where a roller 11 or other suitable conventional means applies a layer of organic insulating material to the conductive base 10 wherein an insulating basecoat 12, which exhibits imperfections or flaw areas 13, is formed thereon and is caused to dry. The conductive base 10 with the dry basecoat 12 and related flaw areas 13 is then conveyed past a corona discharge element S wherein a corona discharge emission electrostatically charges the basecoat 12 with a charge of a given polarity. As the conductive base 10 is conveyed past the corona discharge element S, the conductive base 10 is suitably grounded at point G2 in order that the conductive base 10 will not be substantially effected by the corona emission.

Having uniformly electrostatically charged the basecoat 12, the conductive base 10 is conveyed to a repair station 14 where electrostatically charged repair particles are applied to the basecoat 12 wherein the flaw areas 13 are repaired. The charge on the repair particles is the same as the charged basecoat 12. The conductive base 10 with the repaired basecoat 12 is conveyed to a curing station 15, which may be a heating station or other suitable conventional means, where the repaired basecoat 12 is cured.

Figure 2:
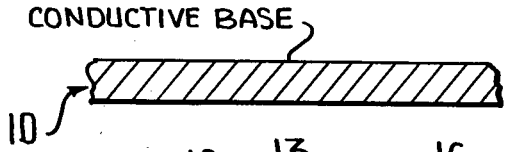
FIG. 2 is a sectional view through a conductive base or substrate.
Figure 3:
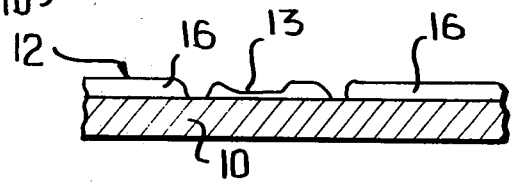
FIG. 3 is a sectional view through the conductive base of FIG. 2 with an imperfect basecoat thereon.
Figure 4:
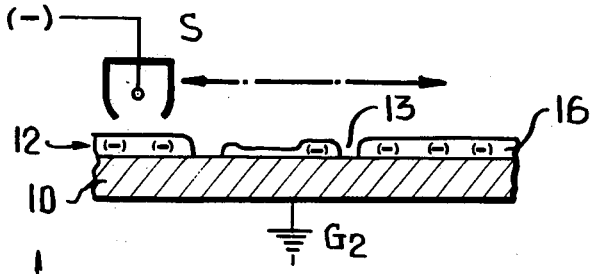
FIG. 4 illustrates the charging of the basecoat of FIG. 3.

Referring next to FIGS. 2 through 6, there will be seen a conductive base or substrate 10 which has relatively good electrically conductive characteristics (FIG. 2). In FIG. 3, a first-down coating is applied to a surface (not specifically illustrated) of the conductive base 10 whereby a basecoat 12 is formed thereon and caused to dry. The basecoat 12 must have conductive characteristics less than the conductive base 10 and normally may be considered to have electrically insulating characteristics. The dry basecoat 12 exhibits uniform areas 16 and flaw areas 13. The flaw areas 13 may be pinholes or thin spots, or both. The flaw areas 13 are unacceptable in manufacturing of container units in that the flaw areas 13 may allow the surface (not specifically illustrated) of the conductive base 10 to contaminate contents of a container unit (not illustrated). Therefore, the flaw areas 13 need to be repaired, and the method of this invention employs the selective application of repair material to repair the flaw areas 13.

Figure 5:
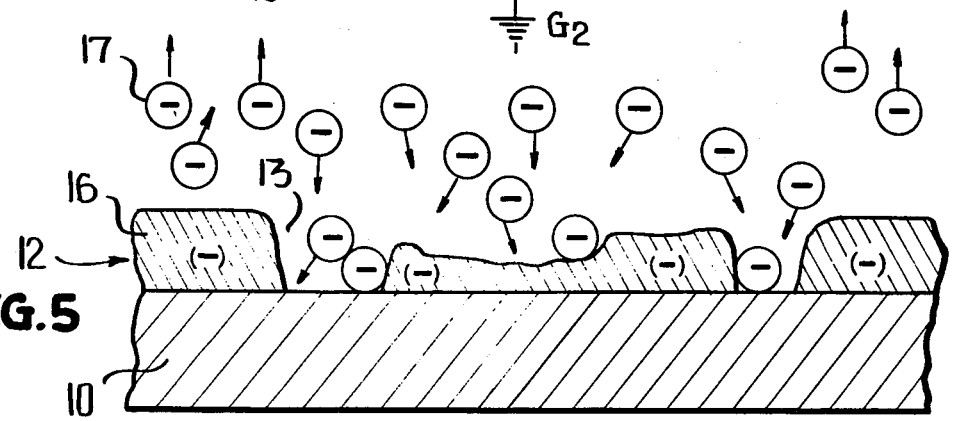
FIG. 5 shows the application of charged repair material particles being attracted in the area of flaws in the basecoat and repelled by uniformly coated portions thereof.

In repairing the flaw areas 13, an imperfect basecoat 12 is electrically charged by exposure to ions produced in a unipolar corona discharge element S, generally referred to in FIG. 5. The basecoat 12 in charged to a negative polarity (−), while the substrate 10 is grounded at G2 whereby the substrate 10 is maintained at least a lesser degree of negative polarity (−) than the negatively charged basecoat 12. Where the negatively charged basecoat 12 is uniform in thickness and composition, as indicated at 16, an electrical field due to the charging exists primarily inside the basecoat 12 at the uniform areas 16. Where the negatively charged basecoat 12 exhibits flaw areas 13, the flaw areas 13 are influenced by the electrically conductive characteristic of the conductive base 10 and the negative charging (−) of the basecoat 12, whereby a fringing effect is created upon the flaw areas 13.

In FIG. 5 there is shown the repairing of the flaw areas 13 by bombarding the negatively charged basecoat 12 with an electrically charged repair material 17 which carries a charge of a negative polarity (−), the same as that of the negatively charged basecoat 12.

Although not specifically illustrated, the charge upon the basecoat 12 could be of a positive polarity (+), and the electrically charged repair material 17 will carry a charge of the same polarity, as illustrated in accordance with this invention.

Figure 6:
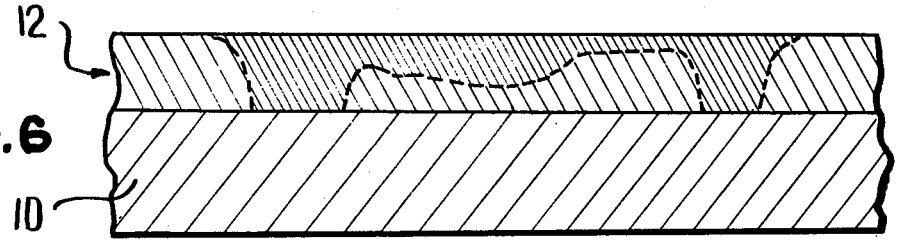
FIG. 6 is a sectional view through the conductive base with the basecoat thereof repaired.

The fringing field effect, associated with the flaw areas 13 resulting from negatively charging (−the basecoat 12, influences the attraction of negatively charged repair material 17 to fill the flaw areas 13. The influence of the fringing field effect is diminished when the negatively charged repair material 17 has repaired the flaw areas 13. Once the flaw areas 13 have been repaired, the negatively charged uniform basecoat 12 acts to repel the negatively charged repair material 17, thereby providing a thin uniform basecoat (FIG. 6).

The repair material 17 may be introduced to the basecoat 12 in various forms, which will be discussed herein. For example, finely divided solid particles may be sprayed onto the basecoat 12 in air, or they may be dispersed in a non-conducting liquid such as kerosene into which the basecoat 12 is immersed, or they may be mixed with a relatively coarse granular material and this mixture cascaded across the basecoat 12. Similarly, liquid droplets may be sprayed onto the basecoat 12 in air or may be dispersed in an emissible non-conducting liquid to form an emulsion.

When the solid particles or liquid droplets are sprayed in the air, they may be electrically charged by exposure to ions in a unipolar corona discharge, which is similar to the corona discharge element S of the present invention. If the particles or droplets are dispersed in a liquid, the composition of a liquid and composition of a repair material can be selected to provide unipolar charging of the repair material.

The novelty of the method of this invention is that the repair material (particles or droplets) be introduced to the electrically charged basecoat 12 in such a manner that the electrostatic attraction resulting from the fringing field effect strongly influences the behavior of the charged particles or droplets. For example, if solid particles are pneumatically sprayed onto the charged basecoat 12, the electrostatic forces should be at least as large as the pneumatic or gravitational forces experienced by the particles. Ideally, the electrostatic forces should dominate the behavior of the particles. Similarly, if the repair material is dispersed in a liquid, the basecoat 12 should be immersed in the liquid or the liquid flowed across the basecoat 12 in a sufficiently gentle manner such that the electrostatic forces are influential.

In the application of thermoplastic solid particles, the particles may be applied by heating them above their respective melting temperature or exposing them to vapors of a suitable solvent. If thermosetting solid particles are used, flow out, bonding, and cross-linking may also be achieved by heating. It may also be desirable in the application of a liquid droplet repair material, that the basecoat 12 to be repaired is heated to dry and cross-link the repair coating. It is also possible to apply droplets of a liquid repair material which is then converted to an adherent solid by exposure to ionizing radiation, such as ultraviolet light or electron beams.

In addition to being capable of repairing the usual types of flaws in coatings, the method of this invention may also be applied to coat an exposed conductive substrate 10 with relatively large exposed areas (not specifically illustrated). In general, so long as at least one dimension of exposed conductive substrate 10 is sufficiently small compared to the area dimensions of the basecoat 12 in that a suitably intense fringing field occurs, then the method of this invention permits a selective application of repair coating to the flaws 13.

Although a preferred embodiment of the invention has been specifically illustrated and described herein, it is to be understood that minor variations may be made in the method without departing from the spirit and the scope of the invention as defined in the appended claims.

I claim:

1. A method of repairing areas of flaws of an electrically insulating, substantially uniform thickness basecoat on an electrically conductive substrate, the flaws including reductions in thickness of the basecoat, said method comprising the steps of overall electrostatically charging the basecoat with a charge of a given polarity while said substrate is maintained at a lesser degree of said given polarity with the areas of flaws of the charged basecoat being influenced by the electrically conductive characteristics of the conductive base and the charging of the basecoat and exhibiting a fringing field effect, electrostatically charging a repair material with a charge of the same polarity as that of the charged basecoat, applying the charged repair material uniformly to the charged basecoat and the areas of flaws with the charged repair material directed towards unflawed portions of said basecoat being repelled and the charged repair material striking said basecoat adjacent said flaws being attracted by the fringing field effect to the areas of flaws, and curing the added basecoat material to provide an overall basecoat of uniform thickness.

2. The method of claim 1 wherein in the step of electrostatically charging the basecoat, the basecoat is charged by a corona discharge.

3. The method of claim 1 wherein in the step of electrostatically charging the repair material, the repair material is charged by a corona discharge.

4. The method of claim 1 wherein the conductive substrate has a greater electrical conductivity than the charged basecoat.

5. The method of claim 1 wherein the repair material is solid particles.

6. The method of claim 1 wherein the attraction of the charged repair material to the areas of flaws gradually diminishes as the area of flaws are filled by the charged repair material.

7. The method of claim 1 wherein said substrate is maintained at a lesser degree of said given polarity by being grounded.

8. A method of uniformly coating a surface of a conductive substrate, said method comprising the steps of overall coating the conductive substrate with an electrically insulating basecoat of a selected thickness in a manner wherein said basecoat undesirably exhibits areas of flaws, the flaws including reductions in the thickness of the basecoat, overall electrostatically charging the basecoat with a charge of a given polarity while said substrate is maintained at a lesser degree of said given polarity with the areas of the flaws of the charged basecoat being influenced by the electrically conductive characteristics of the conductive base and the charging of the basecoat and exhibiting a fringing field effect, electrostatically charging a repair material with a charge of the same polarity as that of the charged basecoat, applying the charged repair material uniformly to the charged basecoat and the areas of flaws with the charged repair material directed towards unflawed portions of said basecoat being repelled with the charged repair material striking said basecoat adjacent said flaws being attracted by the fringing field effect to the areas of flaws, and curing the added basecoat material to provide an overall basecoat of uniform thickness.

9. The method of claim 8 wherein in the step of coating with a basecoat, the basecoat is applied electrostatically.

10. The method according to claim 1 wherein the flaws include absences of the basecoat.

11. A method according to claim 8 wherein the flaws include absences of the basecoat.

* * * * *